US005232287A

United States Patent [19]

Roy

[11] Patent Number: 5,232,287

[45] Date of Patent: Aug. 3, 1993

[54] HANDLES MEANS FOR PACKAGES

[76] Inventor: Ron Roy, 13030 Moorpark #5, Stuido City, Calif. 91604

[21] Appl. No.: 956,672

[22] Filed: Oct. 5, 1992

[51] Int. Cl.[5] ..... B65D 33/12

[52] U.S. Cl. ..... 383/6; 383/14; 383/20; 206/223

[58] Field of Search ..... 383/6, 14, 17, 18, 20; 206/223

[56] References Cited

U.S. PATENT DOCUMENTS

| | | | |
|---|---|---|---|
| 3,033,438 | 5/1962 | Glass | 383/20 |
| 3,207,418 | 9/1965 | Kramming | 383/20 X |
| 3,409,209 | 11/1968 | Finke | 383/20 |

FOREIGN PATENT DOCUMENTS

| | | | |
|---|---|---|---|
| 0483226 | 2/1970 | Switzerland | 383/6 |
| 0817220 | 7/1959 | United Kingdom | 383/14 |

*Primary Examiner*—Allan N. Shoap
*Assistant Examiner*—Jes. F. Pascua
*Attorney, Agent, or Firm*—Joseph E. Mueth

[57] ABSTRACT

A packet which enables the user to attach a pair of carrying handles to a package and containing a pair of flexible cords, four pairs of adhesive tabs having adhesive surfaces on opposed sides thereof, protective strippable flexible plastic sheets covering said surfaces and extending slightly beyond the edge of the surfaces, and four thin rigid plastic sheets, the adhesive tabs preferably being slightly thicker than the diameter of the flexible cords. A package having adhered thereto four pairs of spaced apart adhesive tabs, each tab having opposed adhesive surfaces, two of the pairs of tabs being at one side of the package and the other two at the opposite side of the package, slidably received in the space between each pair of tabs and extending between said two pairs of tabs at each side of the package, a flexible cord, one of said opposed surfaces being adhered to the package and the other opposed surface being adhered to a rigid plastic sheet which bridges two of the pairs of spaced apart adhesive tabs, the tabs preferably being slightly thicker than the diameter of the cords, said flexible cords being adapted to be hand gripped together to provide a carrying handle for the package.

4 Claims, 1 Drawing Sheet

HANDLES MEANS FOR PACKAGES

FIELD OF INVENTION

This invention relates to novel packages with handles and the means to apply such handles to packages.

BACKGROUND OF THE INVENTION

Various devices for carrying packages and providing packages with handles are known. The present invention relates to providing handles on a package which normally in its form at the point of sale is not provided with handles. The present invention provides a packet which can be sold as a sundry or novelty and which contains all of the elements necessary to attach a pair of handles to a package at the point of sale or at any desired time. Thus, this invention is useful for applying handles to a paper or plastic bag, a book, etc..

The packet itself is usable by any ordinary purchaser and can be conveniently and easily applied to facilitate carrying.

It is sincerely believed that this invention is entitled to a patent.

SUMMARY OF THE INVENTION

Briefly, the present invention comprises a packet which enables the user to attach a pair of carrying handles to a package and containing a pair of flexible cords, four pairs of adhesive tabs having adhesive surfaces on opposed sides thereof, protective strippable flexible plastic sheets covering said surfaces and extending slightly beyond the edge of said surfaces, and four thin rigid plastic sheets, said adhesive tabs preferably being slightly thicker than the diameter of said flexible cords.

This invention further comprises a package having adhered thereto four pairs of spaced apart adhesive tabs, each tab having opposed adhesive surfaces, two of the pairs of tabs being at one side of the package and the other two at the opposite side of the package, slidably received in the space between each pair of tabs and extending between said two pairs of tabs at each side of the package, a flexible cord, one of said opposed surfaces being adhered to the package and the other opposed surface being adhered to a rigid plastic sheet which bridges said two of the pairs of spaced apart adhesive tabs, said tabs preferably being slightly thicker than the diameter of said cords, said flexible cords being adapted to be hand gripped together to provide a carrying handle for said package.

It is an object of this invention to provide a novel packet which contains the elements necessary to provide a pair of handles on any package.

It is also an object of this invention to provide an bag or book or the like with a pair of opposed handles by novel means.

It is an important object of this invention to provide means for applying handles to a package in a simple and convenient manner.

These and other objects and advantages of this invention will be apparent from the detailed description which follows.

BRIEF DESCRIPTION OF THE DRAWINGS

The accompanying drawings are for purposes of illustration and depict the presently known preferred mode for practicing this invention. No doubt, variations on this invention will be evident to those skilled in the art.

Turning to the drawings.

DESCRIPTION OF THE PREFERRED EMBODIMENTS

Figure 1:
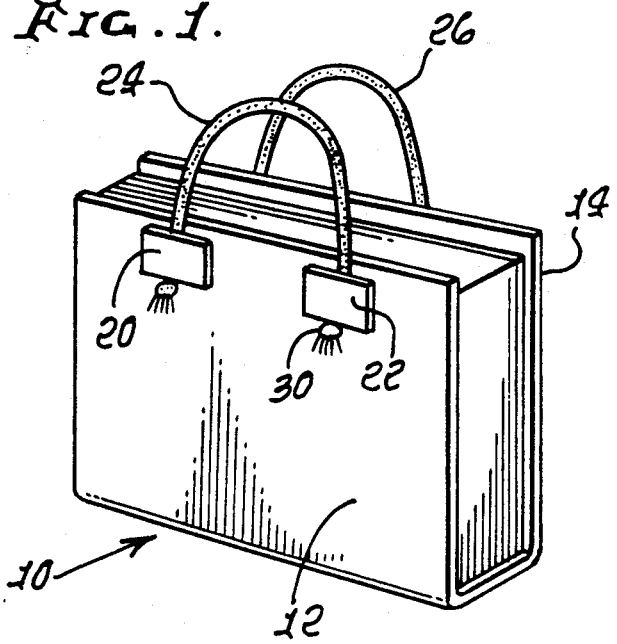
FIG. 1 is a perspective view of one embodiment of this invention.

In the drawings, the package 10, has adhered to each of its opposed sides 12 and 14 two pairs of spaced apart tabs 16 and 18 with overlying bridging rigid plastic elements 20 and 22. The cords 24 and 26 are slidably received between the spaced apart tabs in space 28. The extremities or ends of both cords 24 and 26 are knotted 30 or otherwise enlarged to limit travel of the cords within space 28 and, hence, to be secured to the package.

The package 10 as shown is a book. The package can also be a bag, box, carton or the like.

Figure 3:
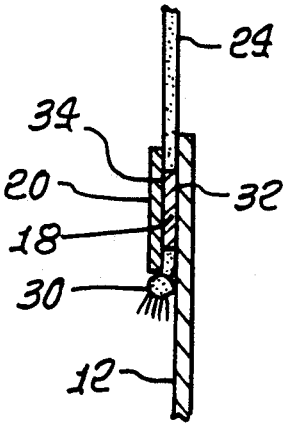
FIG. 3 is a sectional view taken along the line 3—3 in FIG. 2.
Figure 4:
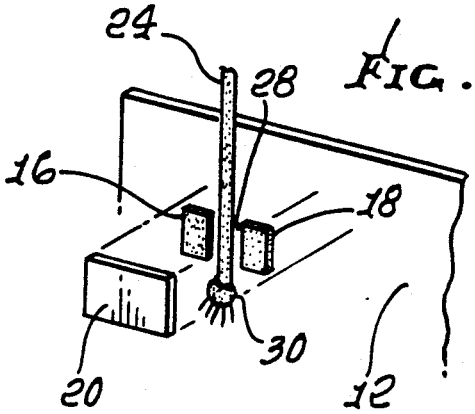
FIG. 4 is an enlarged partial view, in perspective, of the elements of FIG. 2.

The opposed major surfaces of the tabs 16 and 18 are adhesive coated so that one side is adherent to the surface of package 10 and the other side is adherent to bridging element 20. The adhesive surfaces are indicated in FIG. 3 by numerals 32 and 34.

The cords 24 and 26 can be woven or twine, plastic, cotton, etc. and preferably have a diameter less than the thickness of the tabs 16 and 18 so as to be loosely or slidably received in space 28 as noted above. The knot 30 is larger than said thickness of the tabs to prevent the cord from being pulled out of the retainer presented by the package surface, the pair of spaced apart tabs and the bridging element 20.

Figure 6:
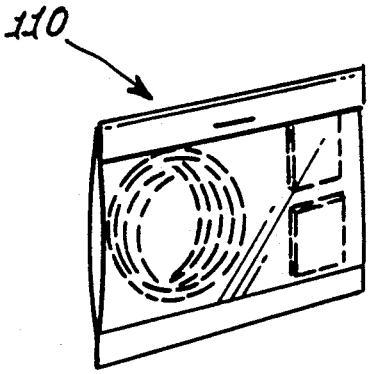
FIG. 6 is a packet containing the elements of this invention.
Figure 2:
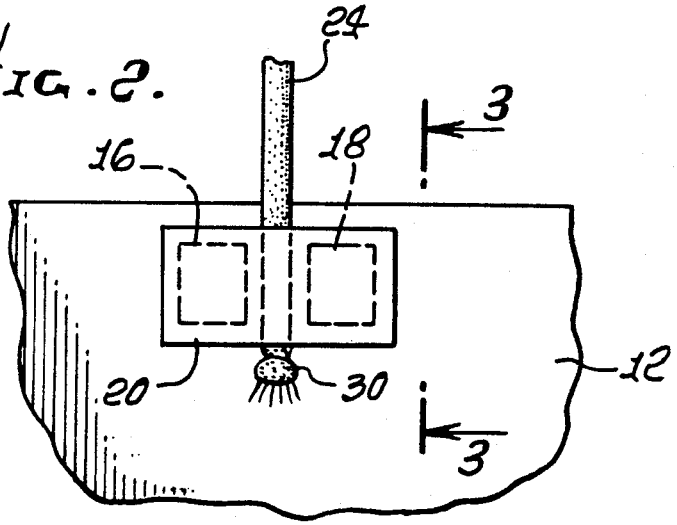
FIG. 2 is an enlarged partial front view of one of the two pairs of spaced apart tabs with handle cord of the embodiment of FIG. 1.
Figure 5:
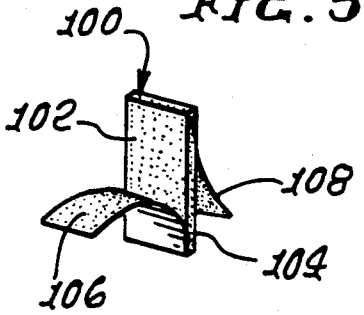
FIG. 5 is a perspective view of the adhesive pads or tabs of this invention.

Considering FIGS. 5 and 6, FIG. 5 shows one of the tabs prior to application to a package. The tab 100 has adhesive surfaces 102 and 104 on each of its opposed major surfaces. The protective strippable flexible plastic sheets 106 and 108 cover these surfaces and extend slightly beyond the edge of the surfaces to provide a finger grip for grasping and easy removal when applying the tab to a package.

The packet 110 is any display type closure or container, normally of the top opening type.

The packet 110 contains four pairs of the tabs 100, two of the plastic bridging elements 20, and two of the cords like 24 and 26. The cords may or may not be end knotted. If not pre-knotted then the user must do the knotting at the time of use.

The tabs may be of plastic or semi-rigid polymeric foam or the like and normally are about ⅛ to 1/16 inch in thickness.

Preferably, the tabs are slightly thicker than the cords to provide sliding movement. However, if the bridging elements 20 have a little "give" to them, then the tab and cord can be of equal thickness or it is even possible for the cord to be slightly thicker in which case the bridging elements bulge outwardly slightly, that is, they are slightly bowed.

Having fully described the invention, it is intended that it be limited solely by the lawful scope of the appended claims.

I claim:

1. A packet which enables the user to attach a pair of carrying handles to a package and containing a pair of flexible cords, four pairs of adhesive tabs having adhesive surfaces on opposed sides thereof, protective strippable flexible plastic sheets covering said adhesive surfaces and four thin rigid plastic sheets, each rigid plastic sheet having a size to completely cover a pair of adhesive tabs and a diameter of said flexible cords, said adhesive tabs having a thickness at least substantially the same as the diameter of said flexible cords.

2. The packet of claim 1 wherein the ends of each of said flexible cords are knotted to a thickness greater than the thickness of said adhesive tabs.

3. A package having adhered thereto four pairs of spaced apart adhesive tabs, each tab having opposed adhesive surfaces, two of the pairs of tabs being at one side of the package and the other two at the opposite side of the package, a flexible cord slidably received in the space between each pair of tabs and extending between said two pairs of tabs at each side of the package, one of said opposed surfaces of each tab of each pair of tabs being adhered to the package, and the other opposed surfaces of each tab of each pair of tabs being adhered to a respective rigid plastic sheet each respective rigid plastic sheet bridging a respective pair of spaced apart adhesive tabs, said tabs having a thickness at least substantially the same as the diameter of said cords, said flexible cords being adapted to be hand gripped together to provide a carrying handle for said package.

4. The package of claim 2 wherein the ends of each of said flexible cords are knotted to a thickness greater than the thickness of said adhesive tabs.

* * * * *